US005137365A

United States Patent [19]

Westrich

[11] Patent Number: 5,137,365

[45] Date of Patent: Aug. 11, 1992

[54] WATER METERING SYSTEM FOR CONCRETE MIXER

[75] Inventor: Milton D. Westrich, Caldwell, N.J.

[73] Assignee: Blend-Rite Industries, Inc., Caldwell, N.J.

[21] Appl. No.: 629,497

[22] Filed: Dec. 18, 1990

[51] Int. Cl.[5] ..... B28C 7/00; B01F 15/02

[52] U.S. Cl. ..... 366/40; 366/34

[58] Field of Search ..... 366/40, 34, 142, 150, 366/151, 348, 349

[56] References Cited

U.S. PATENT DOCUMENTS 3,114,478 12/1963 Hilkemeier et al. .
3,593,966 7/1971 Munroe .
3,631,337 12/1971 MacKinney .
4,298,288 11/1981 Weisbrod .
4,490,044 12/1984 Saito .
4,544,275 10/1985 Hudelmaier ..... 366/40
4,654,802 3/1987 Davis .

*Primary Examiner*—Robert W. Jenkins
*Attorney, Agent, or Firm*—Jordan and Hamburg

[57] ABSTRACT

A water metering system for a concrete mixing truck includes a secure pulsing type cold water meter connected to meter water applied to the mixing drum of the truck. The meter pulses an electrically resettable counter mounted in a secure housing in the cab of the truck. The counter is reset by a key switch mounted in the housing. A manually resettable counter may be mounted to the rear of the truck, to be energized by the meter pulses.

13 Claims, 4 Drawing Sheets

TO POWER SOURCE
15
16
-
+
SECURE HOUSING
18
KEY SWITCH
RESET
13
ELECTRICALLY RESET COUNTER
COUNTER INPUT
30
31
REMOTE COUNTER
35
DISPLAY
12
10
20
21
11
PULSING METER
22

FIG. 4
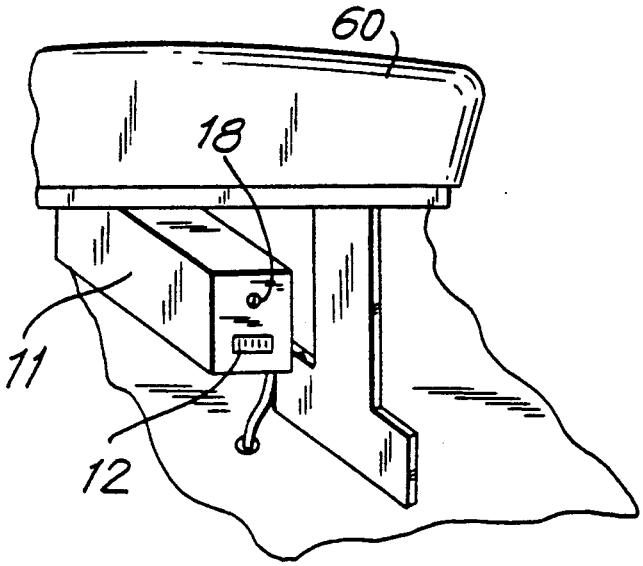
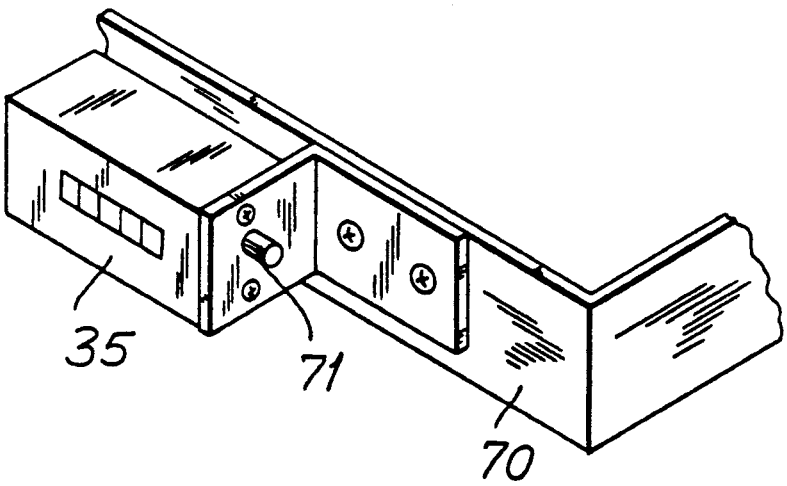
FIG. 5

WATER METERING SYSTEM FOR CONCRETE MIXER

FIELD OF THE INVENTION

This invention relates to a secure metering system for water, for mixing with dry materials in a concrete mixer or the like. The invention is particularly directed to the provision of means for ensuring that the addition of excess water to the mixture is determinable.

BACKGROUND OF THE INVENTION

In order to avoid the addition of excess water or too little water to dry materials, in a concrete truck or the like, to thereby avoid dilution or excess dry material in the mixture, is desirable to provide means for metering the water that is added to the mixture.

In the past, various systems and methods have been proposed in order to provide some degree of control over the water content of the mixture. For example, in U.S. Pat. Nos. 3,593,966 and 4,544,275 a metering system for a concrete mixer is disclosed wherein the inflow of water to the concrete is controlled as a function of the mechanical load on the mixing apparatus, until the load reaches an operator preset value.

U.S. Pat. No. 3,114,478 discloses a metering system for a concrete mixer wherein a water tank mounted on the mixer has an operator settable water quantity dispenser control that permits a determinable amount of water to the dispensed to the mixer.

U.S. Pat. No. 3,631,337 discloses a system for controlling the water added to an aggregate as a function of the moisture entrained in the aggregate.

U.S. Pat. No. 4,654,802 discloses a method for controlling the addition of water to cement, wherein the water is added as a function of the density of the mixed cement.

While such systems enable a determination of the amount of water that was added, or that was to be added, at a given time, they do not ensure that the mixture that was delivered to a job site was not diluted. For example, with such systems, especially those under operator control, the addition of excess water was possible, without a record being maintained of the actual quantity of water added to the mixture. Accordingly, in the past it has been difficult for a concrete supplier to ensure that the concrete that was actually supplied to a job site was of the proper water content. The consequent inability to accurately monitor the addition of water can result in liability of the supplier if a contractor or other user has reason to suspect that the concrete that was supplied was diluted.

Recently, the State of New Jersey has decided that concrete trucks should provide means for monitoring or measuring the amount of water that is added to concrete in concrete trucks, in order to ensure that the concrete is not diluted. At the present time, however, I am not aware of any system that will satisfactorily comply with this requirement.

SUMMARY OF THE INVENTION

The present invention is therefore directed to the provision of a system for accurately and securely monitoring the amount of water added to a mixture in a concrete truck or the like.

Briefly stated, the invention is directed to the provision of a water metering system for a concrete truck having a mixing drum and piping for directing water to said drum. The system comprises a secure water meter in the piping for metering water added to the drum, a secure resettable counter mounted to the truck, and means responsive to the passage of determined quantities of water through the meter for stepping or otherwise advancing the counter. The meter is preferably a pulsing cold/hot water meter that has an accuracy of ±1.5% over the range of flow.

The counter is preferably an electrically reset-table counter mounted in the secure housing, the counter being resettable by a key or 12 volt electrical switch mounted in the housing.

A manually resettable counter may be mounted to the truck and connected to be counted by the meter, for the convenience of the operator of the truck.

BRIEF DESCRIPTION OF THE DRAWING

In order that the invention may be more clearly understood, it will now be disclosed in greater detail with reference to the accompanying drawing, wherein:

FIG. 4 illustrates the mounting of the secure counting arrangement under the seat of the vehicle; and FIG. 5 illustrates the mounting of a remote counter to the concrete mixer truck.

DETAILED DISCLOSURE OF THE INVENTION

Figure 1:
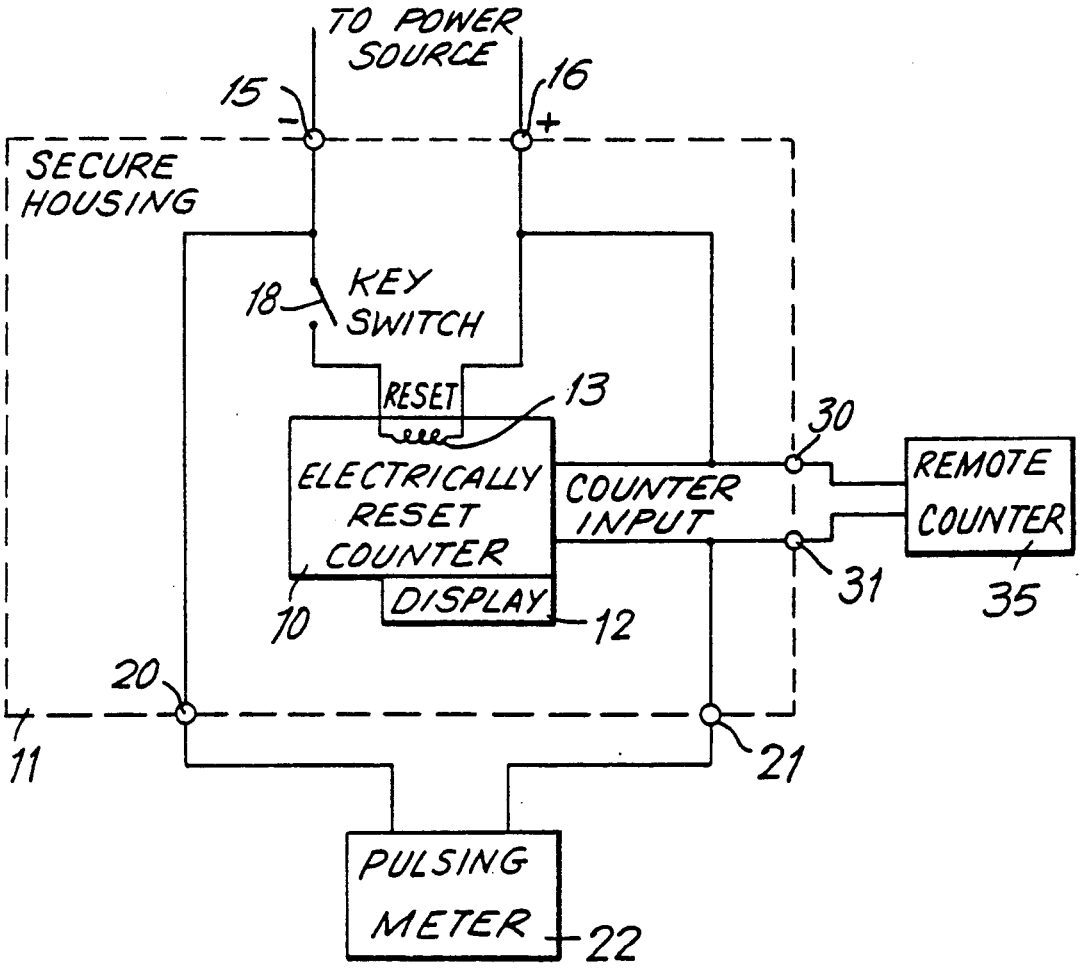
FIG. 1 is block diagram of a preferred embodiment of the electrical circuit of a metering system for a concrete mixer or the like, in accordance with the invention.

Referring now to FIG. 1, in accordance with the invention, an electrically resettable counter 10 is mounted in a secure housing 11, i.e. a housing that inhibits access to the counter 10, and/or ensures that attempts at tampering with the housing to access the counter are readily evident. The counter 10 is preferably of the type having a non-volatile display 12 to avoid loss of the metering information if power is lost. For example, a counter having rotatable display wheels may be advantageously employed. The display 12 is visible from the exterior of the housing. The counter may have an internal solenoid 13 in order to permit the display to be electrically reset. It will be understood, of course, that the invention is not limited to this specific arrangement of the counter.

The housing 11 has a pair of externally accessible terminals 15, 16, for the application of electric current, for example from the battery of the vehicle. These terminals are internally connected to the reset solenoid 13 via a key switch 18 or 12 volt electrical switch, to enable the counter 10 to be reset only by authorized personnel having access to a key for operating the key switch.

The housing also has a pair of externally accessible terminals 20, 21, for connection to a secure water meter 22. The meter 22 is a sealed meter that has an accuracy of ±1.5% over the range of flow. The meter preferably has a range of from 3–50 GPM with an accuracy of at least plus or minus 1½%. The meter may be a secure cold water meter of the type providing a pulsatory output (e.g. one output pulse per gallon of water), such as for example a Kent Positive Displacement Meter Model C-700 BP meter, with a Kent Pulser type "A", type "B" or type "F", manufactured by Kent Meters, Inc, Ocala, Fla.

The terminal 20 is connected to the negative power terminal 15. The terminal 21 is connected to one of the terminals for the counting input of the counter 10, the other counting input terminal being connected to the positive power terminal 16. As a consequence, a counting pulse is applied to the counter 10 upon each passage of a given quantity of water through the meter 22, e.g. each passage of one gallon.

The housing may also have a pair of externally accessible terminals 30, 31, connected in parallel with the counting input of the counter 10. These terminals enable the connection of a manually resettable remote counter 35 to the truck, for use by the driver of the truck. Unlike the counter 22, however, the counter 35 is not secure, i.e. its setting need not provide an accurate record of all water that has passed through the meter 22.

Figure 2:
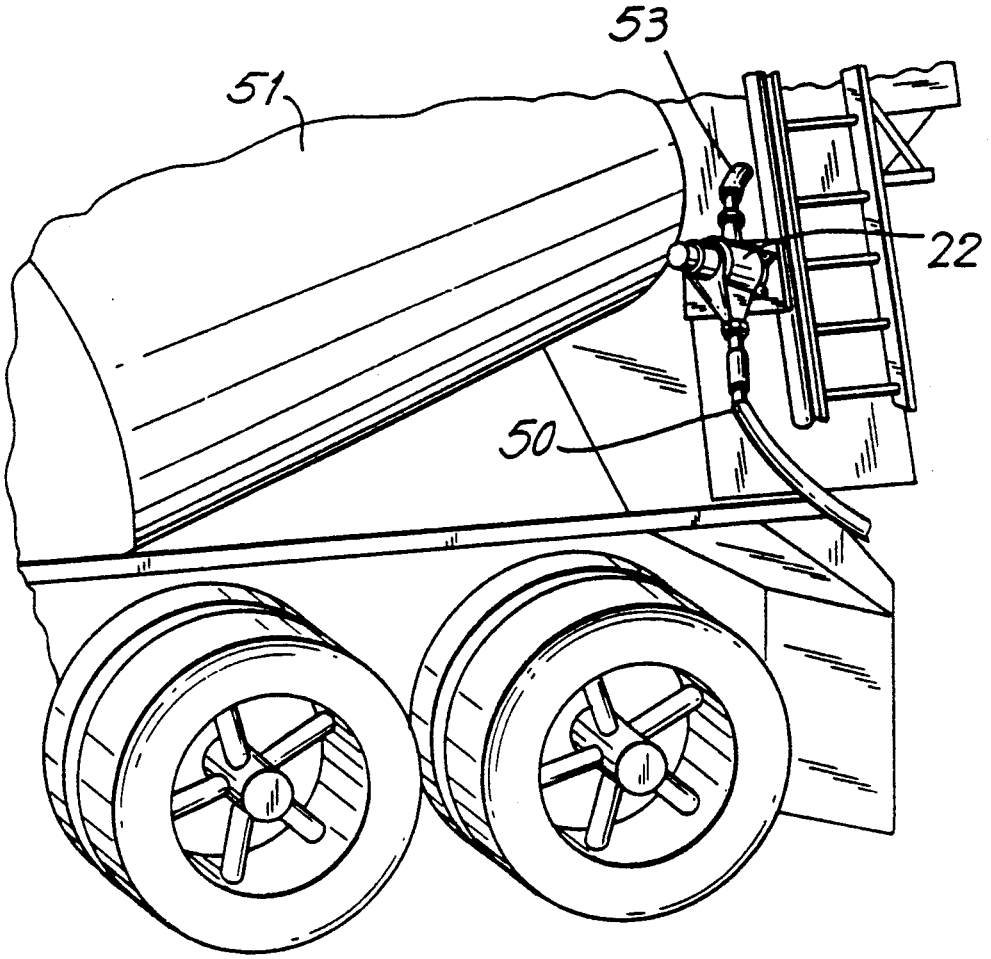
FIG. 2 is a perspective view of a portion of the rear of a concrete mixer truck illustrating the provision of a water meter for metering water added to the mixture in the mixer drum, in accordance with one embodiment of the invention.
Figure 3:
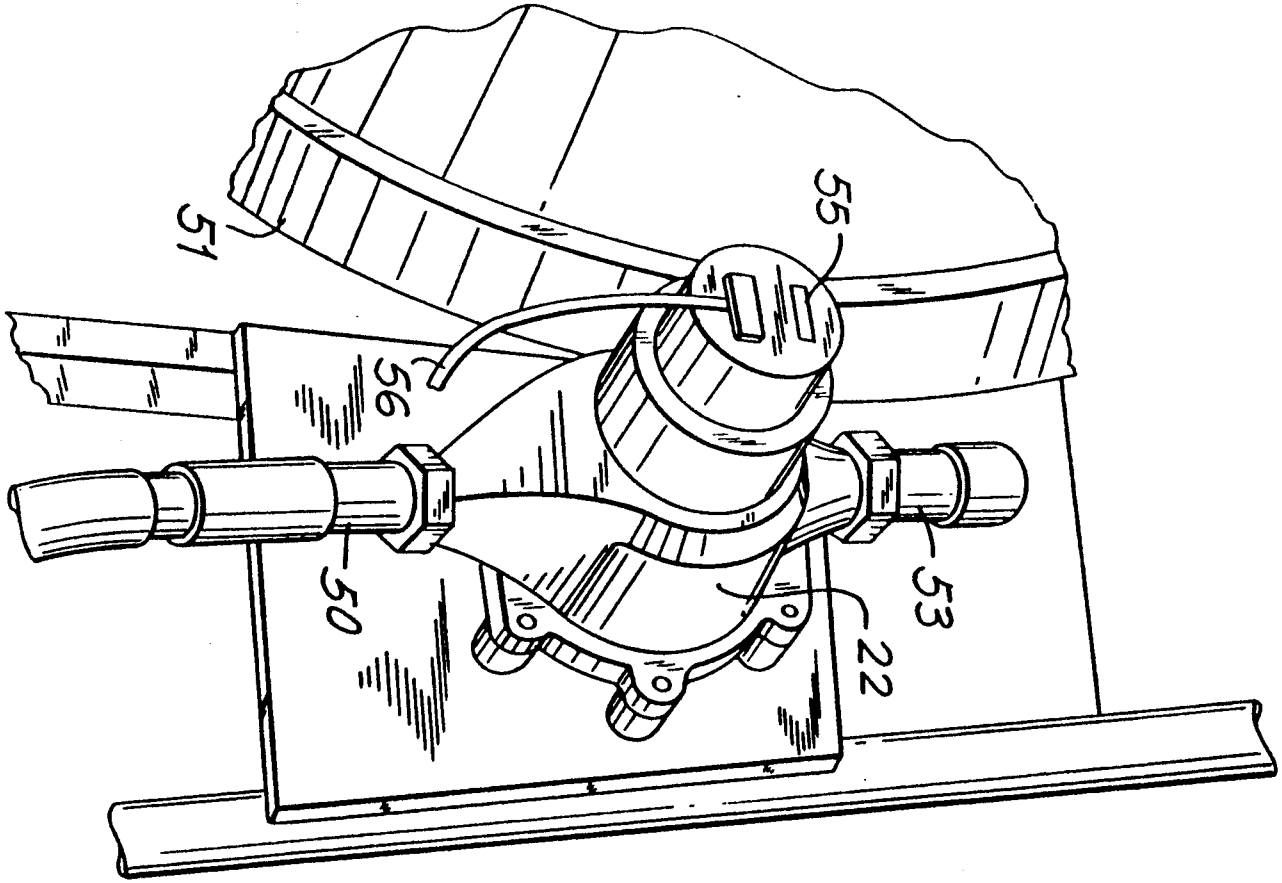
FIG. 3 is an enlarged perspective view of a portion of the arrangement of FIG. 2.

Referring now to FIGS. 2 and 3, the meter 22 is securely mounted to the truck, e.g. by welding to the ladder at the rear of the truck. The water inlet pipe 50 for directing water to the mixing drum 51 is directed to the meter 22, and the water outlet of the meter 22 is connected via pipe 53 directly to the water inlet for the drum. As a consequence, all water directed to the drum passes through the meter 22. The meter 22 has a display 55 that continually displays the quantity of water that has passed through the meter. Leads 56 from the meter are connected to the terminals 20, 21 of the housing 11 of FIG. 1.

As illustrated in FIG. 4, the housing 11 is securely mounted at a convenient location on the truck, for example in the cab under the seat 60, with the counter 12 accessible for reading and the key switch 18 accessible for resetting the counter. It is of course apparent that the housing 11 may alternatively be mounted at other locations on the truck.

FIG. 5 illustrates the mounting of the remote counter 35 at a location on the truck that is readily accessible to the driver, for example on a frame member 70 at the rear of the ladder of the truck. The counter 35 has a reset knob 71 enabling the driver to manually reset this counter.

In accordance with one method for using the metering system in accordance with the invention, after a truck has been loaded, i.e. with water and dry material, and before it has left the loading yard, an inspector resets the counter 22 to zero by use of the key switch. The inspector retains the key, i.e. does not release it to the driver. At any desired later time, either when the truck is on the road or when it returns to the yard, the inspector records the reading of the counter 22, and then resets it to zero. As a consequence the inspector is enabled to maintain an accurate record of the application of any water to the drum between the time that is was initially loaded and the time that the truck returned to the yard. The records of the inspector provide the concrete supplier with positive evidence of lack of dilution of the concrete.

It is apparent that the manually resettable counter of the invention also enables the driver to instantly control the dispensing of water, for more rapid and accurate dispensing of water.

In a modification of the invention, a ticket or tape printer may be connected to the secure resettable counter so that, for example, when an inspector zeros this counter at the beginning of a delivery, the printer prints 0000 on a tape, and so that, at the end of the delivery the printer prints the volume of water delivered, on demand. For example, if 15 gallons was delivered, the printer may print 0015 on the tape. The connection of the printer may be made be conventional techniques. The system may also be provided with suitable connections to enable it to be connected to a microcomputer, card reader or main frame computer, to enable transmission of the counter readings to a data processing system.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. A water metering system for a concrete truck having a mixing drum and piping for directing water to said drum, said system comprising a secure water meter in said piping for metering water added to said drum, a secure resettable counter mounted to said truck, and means responsive to the passage of determined quantities of water through said meter for advancing said counter.

2. The water metering system of claim 1 wherein said water meter is a pulsing cold/hot water meter.

3. The water metering system of claim 2 further comprising a secure housing and wherein said counter is an electrically resettable counter mounted in said secure housing.

4. The water metering system of claim 3 further comprising a secure switch mounted in said housing for resetting said counter.

5. The water metering system of claim 4 wherein said secure switch is a key or 12 volt electrical switch.

6. The water metering system of claim 1 further comprising a manually resettable counter mounted to said truck and connected to be advanced by said meter.

7. A water metering system for a concrete truck having a mixing drum and piping for directing water to said drum, said system comprising a secure water meter that provides a pulsatory output responsive to the passage of determined quantities of water therethrough, said meter being connected to meter water passing to said drum via said piping, a secure housing, an electrically counting and resettable counter mounted in said secure housing, means connecting said meter to energize said counter to count pulses therefrom, and secure means for electrically resetting said counter.

8. The water metering system of claim 7 wherein said meter having an accuracy of at least plus or minus 1½%.

9. The water metering system of claim 7 further comprising a manually resettable counter mounted to said truck and connected to be energized by pulses from said meter.

10. The water metering system of claim 7 further comprising a key switch mounted in said housing and connected to electrically reset said counter.

11. The water metering system of claim 7 wherein said truck has a cab, and said secure housing is mounted in said cable.

12. The water metering system of claim 11 comprising a seat in said cab, and wherein said secure housing is mounted under said seat.

13. The water metering system of claim 7 wherein said counter has a reset solenoid, and further comprising a key or 12 volt electrical switch mounted in said housing and connected to energize said solenoid.

* * * * *